US007121113B2

(12) United States Patent
Chung et al.

(10) Patent No.: US 7,121,113 B2
(45) Date of Patent: Oct. 17, 2006

(54) BUILT-IN TYPE REFRIGERATOR

(75) Inventors: Eui Yeop Chung, Seoul (KR); Tae Hee Lee, Seoul (KR); Se Young Kim, Seoul (KR); Kyung Sik Kim, Incheon (KR); Yang Gyu Kim, Seoul (KR); Hi Chol Lee, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/151,522

(22) Filed: Jun. 14, 2005

(65) Prior Publication Data

US 2005/0223735 A1 Oct. 13, 2005

Related U.S. Application Data

(62) Division of application No. 10/614,822, filed on Jul. 9, 2003, now Pat. No. 6,925,836.

(30) Foreign Application Priority Data

Jul. 24, 2002 (KR) ..... P2002-0043602

(51) Int. Cl.
*F25B 39/04* (2006.01)

(52) U.S. Cl. ..... 62/507; 165/169

(58) Field of Classification Search ..... 62/259.1, 62/428, 507, 508, 516; 122/32, 367.3; 165/168, 165/169, 183
See application file for complete search history.

(56) References Cited

U.S. PATENT DOCUMENTS 2,449,207 A 9/1948 Guyon
2,708,350 A 5/1955 Guyon
3,839,880 A 10/1974 Premaza
3,934,554 A 1/1976 Carlson
4,156,352 A 5/1979 Gelbard et al.
4,555,915 A 12/1985 Dasher
5,502,983 A 4/1996 Dasher
5,676,911 A 10/1997 Baumert et al.
5,881,567 A 3/1999 Junge et al.
6,688,126 B1 2/2004 Kim et al.
2002/0014086 A1 2/2002 Holzer et al.
2003/0029189 A1 2/2003 Wilson

FOREIGN PATENT DOCUMENTS

DE 19933603 1/2001
GB 2338287 12/1999

OTHER PUBLICATIONS

English Language Abstract of DE 19933603
U.S. Appl. No. 11/151,707 to Chung et al., filed Jun. 14, 2005.
U.S. Appl. No. 11/151,521 to Chung et al., filed Jun. 14, 2005.

*Primary Examiner*—William E. Tapolcai
(74) *Attorney, Agent, or Firm*—Greenblum & Bernstein, P.L.C.

(57) ABSTRACT

Disclosed is a built-in refrigerator provided in a sink and effectively discharging heat from a condenser and a compressor. The built-in refrigerator includes a cabinet provided in the sink and a component chamber at a rear bottom thereof and a dust guard provided at a front bottom of the cabinet; a compressor provided in the component chamber; a condenser provided under a bottom surface of the cabinet; a ventilating passage communicating the component chamber with a bottom of the cabinet and outside of the dust guard for discharging heat generated from the condenser and the compressor to outside; and a cooling fan provided in the component chamber for cooling the compressor and the condenser.

8 Claims, 4 Drawing Sheets

BUILT-IN TYPE REFRIGERATOR

CROSS-REFERENCE TO RELATED APPLICATIONS

This is a divisional application of U.S. application Ser. No. 10/614,822, filed Jul. 9, 2003 now U.S. Pat. No. 6,925,836, the contents of which is expressly incorporated by reference herein in its entirety.

This application claims the benefit of Korean Application No. P2002-0043602, filed on Jul. 24, 2002, which is hereby incorporated by reference as if fully set forth herein.

BACKGROUND OF THE INVENTION

1. Field of Invention

The present invention relates to a refrigerator, and more particularly, to a ventilating system of a built-in type refrigerator.

2. Discussion of the Related Art

In general, a refrigerator is an apparatus for taking storage of foods freshly for a long-term period, and is divided into a cabinet with a freezer or a refrigerator chamber for taking storage of foods in frozen or cold storage states, and a refrigerating cycle for cooling the freezer or the refrigerator chamber. The refrigerating cycle is formed of a process of compression, condensation, expansion and evaporation, and repeats the process to refrigerate the freezer or the refrigerator chamber.

Refrigerant compressed in the process of the compression by a compressor discharges heat and is changed to refrigerant having low enthalpy in a condenser, and enters into an evaporator after adiabatic expansion by an expansion valve. The refrigerant being entered into an evaporation valve absorbs heat in a refrigerator chamber through the isothermal expansion process and uses the heat as latent heat.

Furthermore, the condenser discharges heat by exchanging heat with outside air of refrigerator, and the evaporator absorbs heat by exchanging heat with the freezer or the refrigerator chamber in the refrigerator.

A conventional refrigerator is provided at one sidewall of a kitchen or a living room and it is protruded by its size to badly affect on beauty on appearance, and there is also caused a drawback in that practical space use is lowered.

To this end, in these days, there is being requested the development of a built-in refrigerator which one part of a body thereof enters into the wall in or can be provided at the sink. When a refrigerator is provided in a sink, there is a limitation of space needed for inflowing open air to cool the condenser and the compressor. Hence, there is focused a ventilation technology for effectively ventilating the heat generated from the condenser and the compressor.

SUMMARY OF THE INVENTION

Accordingly, the present invention is directed to a built-in refrigerator that substantially obviates one or more problems due to limitations and disadvantages of the related art.

An object of the present invention is to provide a built-in refrigerator, which can be provided at a sink.

Another object of the present invention is to provide a built-in refrigerator, which can effectively discharge heat from a condenser and a compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a built-in refrigerator includes a cabinet provided in a sink and having a component chamber at a rear bottom thereof; a dust guard provided at a front bottom thereof; a compressor provided in the component chamber; a condenser provided under a bottom surface of the cabinet; a ventilation passage communicating the component chamber with a bottom of the cabinet and outside of the dust guard for discharging heat generated from the condenser and the compressor; and a cooling fan provided in the component chamber for cooling the condenser and the compressor.

In a first embodiment of the present invention, the condenser includes a refrigerant tube received into a receiving portion under the bottom surface of the cabinet and a cooling fin having a first end being connected to the refrigerant tube and a second end being exposed to the ventilation passage.

In a second embodiment of the present invention, the condenser includes the refrigerant tube exposed on the bottom surface of the cabinet and the cooling fin having the first end being connected to the refrigerant tube and the second end being exposed to the ventilation passage.

In a third embodiment of the present invention, the condenser includes the refrigerant tube having the first end received into the receiving portion under the bottom surface of the cabinet and a cooling fin having the first end being connected to the refrigerant tube and the second end being exposed to the ventilation passage. In each above-mentioned embodiment, the cooling fin and the refrigerant tube are formed as a single body.

In a fourth embodiment, the built-in refrigerator includes a bottom plate forming a bottom surface of the condenser. Also, in the fourth embodiment of the present invention, the condenser of the built-in refrigerator includes the refrigerant tube having a bottom surface being in contact with an upper surface of a bottom plate under a bottom surface of the cabinet and a cooling fin provided for each of the corresponding refrigerant tube on the bottom surface of the bottom plate. Here, the cooling fin includes a cross section in a "T" form, and is welded to the bottom plate.

In each embodiment of the present invention, the cooling fin includes a long and thin plate parallel to an airflow direction in the ventilation passage and is vertically extended downward from the refrigerant tube.

The built-in refrigerator further includes a divider for dividing the ventilation passage into an air inlet passage and an air outlet passage. The divider is vertically extended to a surface of the condenser and is formed of a diaphragm blocking airflow.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
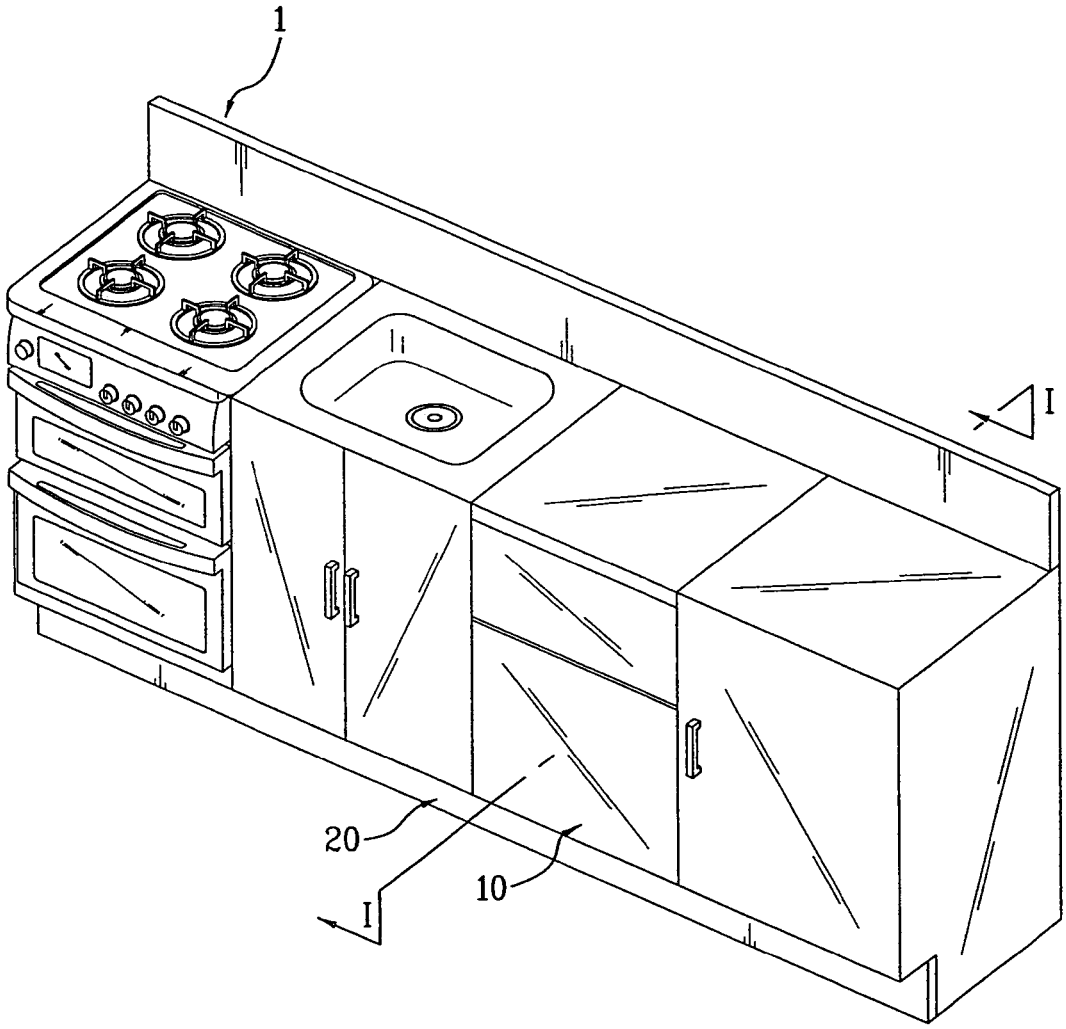
FIG. 1 illustrates a perspective view of a built-in refrigerator provided in a sink according to the present invention.
Figure 2:
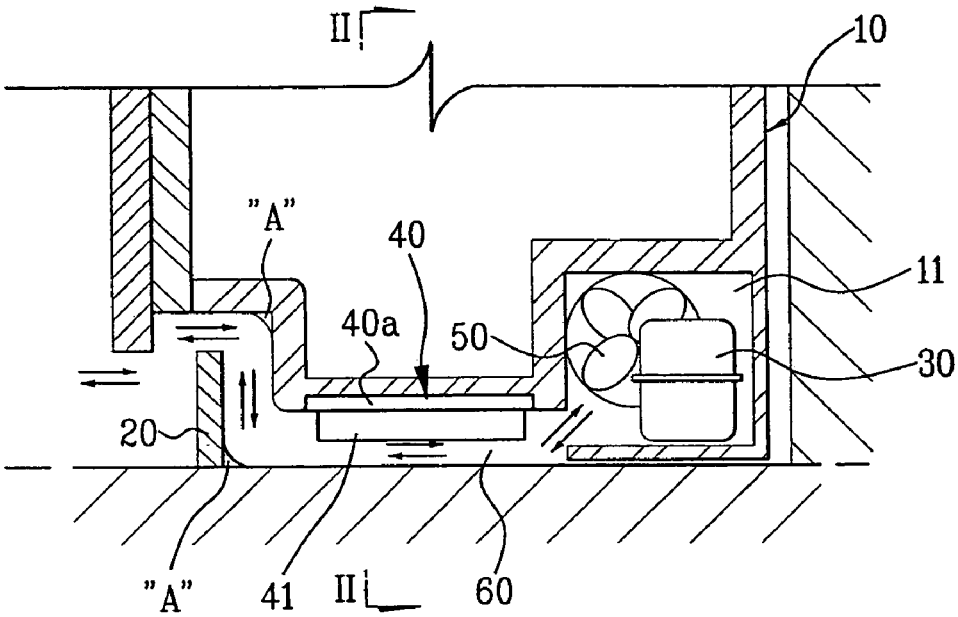
FIG. 2 is a sectional view taken along the line I—I of FIG. 1 and illustrates a ventilating system of the built-in refrigerator according to the present invention.

FIG. 1 is a perspective view of a built-in refrigerator provided in a sink according to the present invention, and FIG. 2 is a sectional view taken along the line I—I of FIG. 1 and illustrates a ventilating system of a built-in refrigerator according to the present invention.

The built-in refrigerator according to the present invention, as illustrated in FIGS. 1 and 2, includes a cabinet 10, a dust guard 20, a compressor 30, a condenser 40, ventilation passage 60 located at a bottom of the cabinet 10 and a cooling fan 50.

The Cabinet 10 provided in a sink 1 has a door at a front side thereof and a component chamber at a rear bottom thereof. It forms an exterior of the built-in refrigerator. Although it is not illustrated, the evaporator as a structural element of a refrigerating cycle is provided in the freezer or the refrigerator chamber and functions of cooling by absorbing heat. The expansion valve is provided between the evaporator and the condenser. Here, The dust guard 20 is vertically provided between a front bottom of the cabinet 10 and a floor.

In FIG. 1, the dust guard 20 is horizontally provided to be continuous with a lower part molding of the sink 1 in which the built-in refrigerator is provided so as to improve design. Also, the dust guard 20 is provided between the floor outside of the built-in refrigerator and the ventilation passage 60 to prevent peripheral garbage during cleaning from being introduced into the ventilation passage 60.

In FIG. 2, the ventilation passage 60 is formed at the bottom of the cabinet 10, and discharges heat generated from the condenser 40 and the compressor 30.

The ventilation passage 60 according to the present invention is located at the bottom of the cabinet 10 and discharges heat generated from the condenser and the compressor to outside. That is, the ventilation passage 60 is formed for airflow by forming a predetermined distance between the bottom surface of the cabinet 10 and the floor.

A section between a top of the dust guard 20 and the bottom of the cabinet 10 functions as an entrance and an exit of ventilating air. The ventilation passage 60 has a structure communicating the component chamber 11 with the bottom of the cabinet 10 and an outside of the dust guard 20. That is, air sucked by the cooling fan from the section passes through the ventilation passage 60 and flows into the component chamber 11. After passing through the component chamber 1 the air flows back to the ventilation passage 60 so as to flow out through the section.

Also, air ventilated by the fan 50 cools the condenser and the compressor. The airflow passage should have a structure to flow air smoothly. As it is illustrated in FIG. 2, an airflow direction is sharply changed at corners of the entrance and exit of air in the ventilation passage 60. Therefore, corners "A" of the entrance and exit of air near the dust guard 20 are rounded to reduce the pressure generated from the sudden change of the airflow direction so as to heighten the cooling efficiency of the condenser provided in the ventilation passage 60.

The condenser 40, as illustrated in FIG. 2, should be provided under the bottom surface of the cabinet 10 because it is difficult to provide the condenser at the rear of the cabinet or in the component chamber owing to the characteristics of the built-in refrigerator. Even though the condenser is provided, it is difficult to treat heat generated from the condenser 40. Also, airflow is fast in the ventilation passage 60 between the bottom surface of the cabinet 10 and the floor, and the ventilating efficiency of the condenser 40 is much more improved than when it is provided at the rear of the cabinet 10 or in the component chamber 40.

The component chamber 11 has relatively large equipments such as the compressor 30, and a unit area of the component chamber is larger than that of the ventilation passage 60. When the unit area is large, air flowing speed is slow and the ventilating efficiency is declined. Hence, when the condenser is provided in the ventilation passage 60 at the bottom of the cabinet 10, the airflow speed is fast and the ventilating efficiency is improved more.

Accordingly, it is desirable that the condenser be provided at the bottom of the cabinet 10, where the ventilation passage 60 is formed. When the condenser 40 is provided in the ventilation passage 60 at the bottom of the cabinet 10, the ventilating efficiency is improved owing to the fast airflow speed and the size of the component chamber is reduced.

Figure 3:
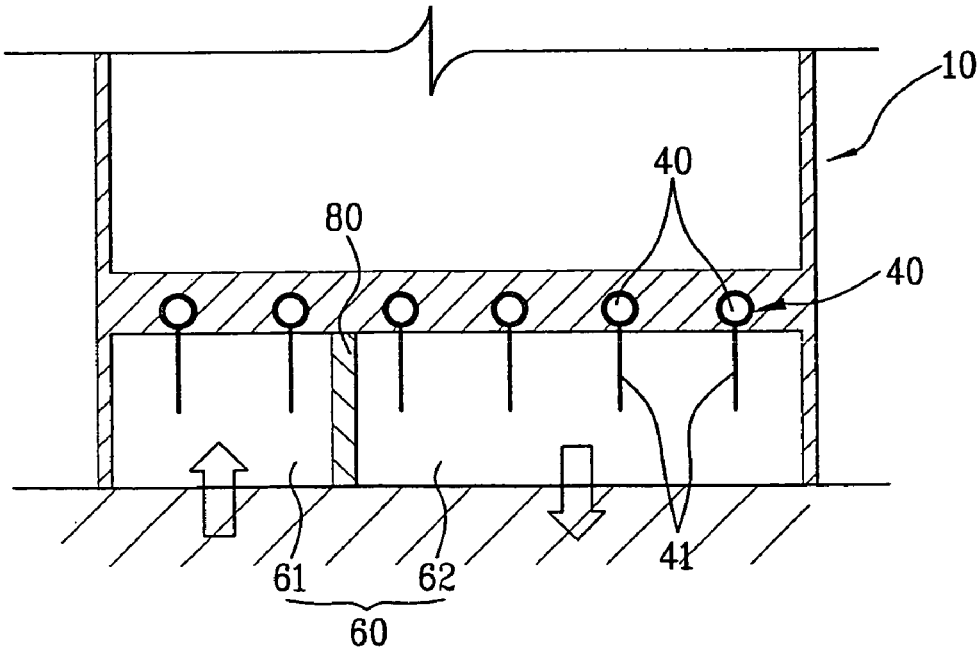
FIG. 3 is a sectional view taken along the line II—II of FIG. 2 and illustrates the ventilating system in a condenser according to a first embodiment of the present invention.

Hereinafter, the embodiment of the present invention is explained in more detail according to the aforementioned ventilating system. FIG. 3 is a sectional view taken along the line II—II of FIG. 2 and illustrates the ventilating system in the condenser according to a first embodiment of the present invention. The condenser 40 in FIG. 3 includes a refrigerant tube received into a receiving portion under the bottom surface of the cabinet 10 and a cooling fin 41 having a first end being connected to the refrigerant tube 40*a* and a second end being exposed to the ventilation passage 60 between the cabinet 10 and the floor.

What the refrigerant tube is provided and received into the receiving portion at the bottom of the cabinet 10 does not mean that it is buried in the material forming the bottom of the cabinet 10.

When the refrigerant tube 40*a* is provided to project on the ventilation passage 60, airflow is disturbed by the refrigerant tube 40*a*. To prevent this, the refrigerant tube 40*a* has a structure that it is received into a receiving portion at the bottom of the cabinet 10, and has a thin plane at a bottom of the refrigerant tube for separating the ventilation passage and the refrigerant tube.

In FIG. 2, the lowest surface of the refrigerant tube 40*a* of the condenser in the ventilation passage 60 is in accordance with the lower surface of the cabinet 10 so that airflow is not disturbed by the refrigerant tube 40*a*.

Figure 4:
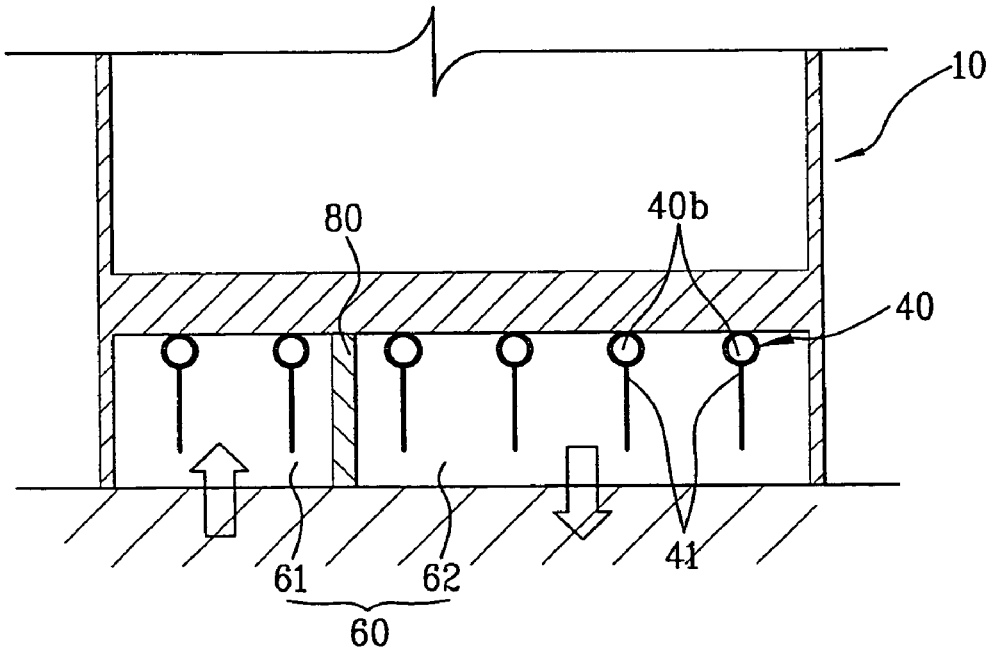
FIG. 4 is a sectional view taken along the line II—II of FIG. 2 and illustrates the ventilating system in a condenser according to a second embodiment of the present invention.

FIG. 4 is a sectional view taken along the line II—II of FIG. 2 and illustrates the ventilating system in the condenser according to a second embodiment of the present invention.

In FIG. 4, the condenser 40 includes the condenser 40*b* being exposed on the bottom surface of the cabinet 10 and the cooling fin 41 having the first end being connected to the refrigerant tube 40*b* and the second end being exposed to the ventilation passage 60.

The refrigerant tube 40*b* is exposed being projected in the ventilation passage 60 on the bottom surface of the cabinet 10 for more efficient heat exchange.

That is, the refrigerant tube 40*b* of the condenser 40 is provided under the bottom surface of the cabinet 10 and can be exposed in the ventilation passage 60 by such a supporting structural material as ankh.

Figure 5:
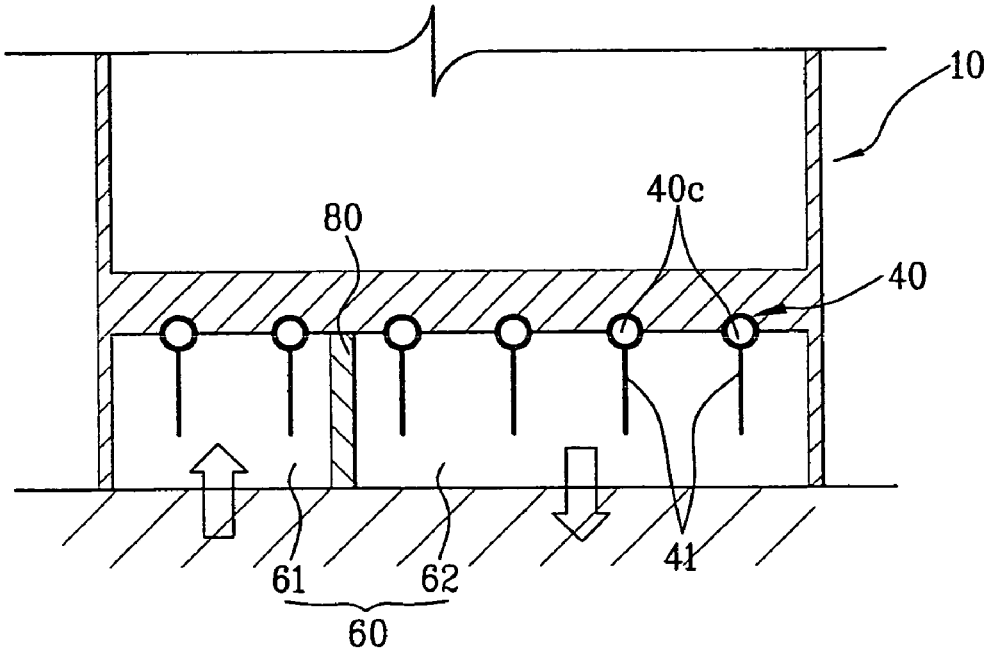
FIG. 5 is a sectional view taken along the line II—II of FIG. 2 and illustrates the ventilating system in a condenser according to a third embodiment of the present invention.

FIG. 5 is a sectional view taken along the line II—II of FIG. 2 and illustrates the ventilating system in the condenser according to a third embodiment of the present invention;

In FIG. 5, the condenser includes a refrigerant tube 40*c* having a first side being received into the receiving portion at the bottom of the cabinet 10 and a second side being exposed to the ventilation passage 60, and a cooling fin 41 having the first end being connected to the refrigerant tube 40*c* and the second end being exposed to the ventilation passage 60.

A proper heat exchange and smooth airflow are guaranteed at the same time by a structure that the first side of the refrigerant tube 40*c* is received into the receiving portion and a second side of the refrigerant tube 40*c* is projected in the ventilation passage 60.

In FIG. 5, a thin plate is used to separate the second side of the refrigerant tube 40*c* from the ventilation passage 60 as explained in the first embodiment of the present invention. That is, the thin plate is provided to be in contact with the central part on each end surface of the refrigerant tube 40*c*.

In each aforementioned embodiment, it is desirable that the refrigerant tube of the condenser 40 and the cooling fin 41 be formed as a single body. However, if it can maintain high rate of heat transmission, the refrigerant tube and the condenser 40 can be combined with each other after being produced separately.

Also, it is desirable that the cooling fin 41 should include a long and thin plate parallel to an airflow direction in the ventilation passage 60. That is, an air contact area of the cooling fin 41 should be increased for the cooling fin 41 to effectively exchange heat with air. As in FIG. 2, not to block airflow with the cooling fin 41 by itself, it is desirable that the cooling fin 41 be formed long and parallel to the airflow direction.

Also, as in FIGS. 3–5, the cooling fin 41 is vertically extended downward from the refrigerant tubes 40*a*, 40*b* and 40*c* for preventing the airflow from being blocked by the cooling fin 41.

It is advantageous that the length of the cooling fin is longer to increase the air contact area of the cooling fin 41 from a point of view of heat transmission. And, in case that the length of the cooling fin 41 is so short, the effective heat exchange is not realized because the air contact area of the cooling fin 41 is small. The structure of the cooling fin is applied to each aforementioned embodiment of the invention.

Figure 6:
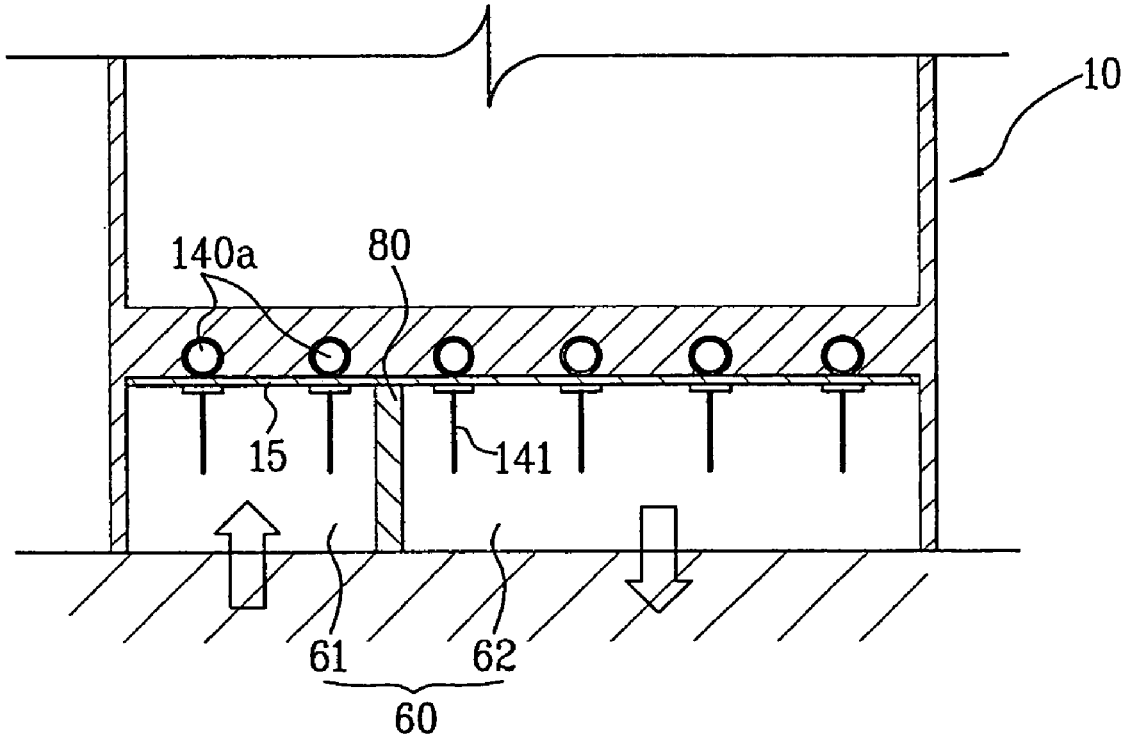
FIG. 6 is a sectional view taken along the line II—II of FIG. 2 and illustrates the ventilating system in a condenser according to a fourth embodiment of the present invention.

FIG. 6 is a sectional view taken along the line II—II of FIG. 2 and illustrates the ventilating system in the condenser according to a fourth embodiment of the present invention. The fourth embodiment includes a bottom plate 15 forming a lower surface of the condenser 140.

In this embodiment, the condenser 140 includes a refrigerant tube 140*a* having a bottom surface being in contact with an upper surface of a bottom plate under the bottom surface of the cabinet and a cooling fin 141 provided for each of the corresponding refrigerant tube 140*a* on the bottom surface of the bottom plate 15.

Therefore, in this embodiment, not only is airflow smooth in the ventilation passage but also an installation of the cooling fin and manufacture of the refrigerator are easy as the cooling fin 141 can be adhered on an outer surface of the bottom plate 15.

It is desirable that the bottom plate 15 be made of a high-heat conductive material. Also, Copper is recommended for a material to make the bottom plate 15 such that copper is high-heat conductive and economical.

It is desirable that a cross section of the cooling fin 141 be formed in "T" shape to increase a heat conductive area at the contact area of the cooling fin 141 and the bottom plate 15 when they are assembled.

It is desirable that both the bottom plate 15 and the cooling fin 141 provided on the bottom late 15 be formed as a single body to secure high heat conductivity. However, the cooling fin 141 can be welded to the bottom plate 15.

As described in the first and third embodiments, it is desirable that the cooling fin 141 includes a long and thin plate parallel to the airflow direction of the ventilation passage 60.

An air-contact area of the cooling fin 141 should be increased to the maximum for effective heat conduction in air. Therefore, as in FIG. 2, the cooling fin 141 is formed to be parallel to the airflow direction of the ventilation passage in order to prevent the cooling fin 141 from blocking the airflow itself.

Also, as in FIG. 6, the cooling fin 141 is vertically extended downward from the bottom plate 15. This is to prevent airflow from being blocked by the cooling fin 141.

Meanwhile, it is desirable that a separator 80 be provided in the ventilation passage 60 for separating the ventilation passage 60 into an air inlet passage 61 and an air outlet passage 62 so as to prevent inflow air from being mixed with outflow air in the ventilation passage 60.

Hereinafter, airflow during ventilation of the component chamber in the built-in refrigerator will be explained in more detail referring to FIGS. 2–3.

As illustrated in FIGS. 3–6, it is desirable that the separator 80 is vertically extended to a surface of the condenser 40 and is formed of a diaphragm blocking airflow.

First, when the cooling fin 41 in the component chamber operates, cold air outside flows into the component chamber through the air inlet passage 61 and hot air flows outward through the air outlet passage 62.

The area of the air inlet passage 61 is formed to be smaller than that of the air outlet passage 62. It is because air pressure decreases by air contact with a surface of the ventilation passage 60 and the cooling fin 41 during air inflow by the cooling fin 41. Air finished heat-exchange by lowered pressure should flow out and bigger area of the air outlet passage 62 is better for heat exchange and smooth outflow of air.

When the ventilation passage 60 is composed of the air inlet passage 61 and the air outlet passage 62, the area of each flow becomes smaller and air flowing into the ventilation passage 60 passes through the cooling fin 41 at higher speed releasing heat out from the condenser 40. Hence, air in the component chamber efficiently ventilates the compressor 30.

The structure dividing the ventilation passage 60 into the air inlet passage 61 and the air outlet passage 62 by providing the separator 80 in the ventilation passage 60 is applied to all aforementioned embodiments according to the present invention.

Accordingly, practical space use of a kitchen or a living room and the beauty on appearance are improved with the built-in refrigerator according to the present invention. Also, a unique effect of the dust guard as well as the ventilation is maintained.

As the condenser 40 is provided in the ventilation passage 60 under the bottom surface of the cabinet, the ventilation efficiency as well as the practical space use is improved by high speed of airflow.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents. As mentioned above, the built-in refrigerator has the following effect.

First, according to the invention, a refrigerator is provided in the sink, and practical space use of a kitchen or a living room and the beauty on appearance are improved. Particularly, the dust guard is horizontally extended under the front surface of the sink 1 so as to effectively ventilate the component chamber of the refrigerator. Therefore, as aforementioned, the unique effect of the dust guard as well as the ventilation is maintained.

Second, according to the invention, as the condenser is provided in the ventilation passage under the bottom surface of the cabinet, the ventilation efficiency of the condenser and the practical space use of the component chamber are improved by the high speed of airflow. Also, the practical space use of the kitchen or the living room is improved as the refrigerator is provided in the sink.

What is claimed:

1. A built-in refrigerator comprising:

a cabinet provided in a sink and having a component chamber at a rear bottom thereof;

a dust guard provided between a front bottom of the cabinet and a floor;

a compressor provided in the component chamber;

a condenser provided under a bottom surface of the cabinet;

a ventilation passage communicating the component chamber with a bottom of the cabinet and outside of the dust guard to discharge heat generated from the condenser and the compressor to outside; and a cooling fan provided in the component chamber to cool the condenser and the compressor; and a divider that divides the ventilation passage into an air inlet passage and an air outlet passage, wherein the condenser comprises a bottom plate provided under a bottom surface of the cabinet, a refrigerant tube that passes refrigerant therethrough, the refrigerant tube having a bottom surface in contact with an upper surface of a bottom plate under a bottom surface of the cabinet, and a cooling fin having a first end connected to the corresponding refrigerant tube on the bottom surface of the bottom plate and a second end exposed to the ventilation passage.

2. The built-in refrigerator as claimed in claim 1, wherein the cooling fin has a cross section in a "T" form.

3. The built-in-refrigerator as claimed in claim 1, wherein the cooling fin is welded to the bottom plate.

4. The built-in refrigerator as claimed in claim 1, wherein the cooling fin comprises a long and thin plate parallel to an airflow direction in the ventilation passage.

5. The built-in refrigerator as claimed in claim 1, wherein the cooling fin extends vertically downward from the refrigerant tube.

6. The built-in refrigerator as claimed in claim 1, wherein the divider extends vertically to a surface of the condenser and is formed as a diaphragm blocking airflow.

7. The built-in refrigerator as claimed in claim 1, wherein an upper portion of the refrigerant tube is received into the bottom surface of the cabinet.

8. The built-in refrigerator claimed in claim 1, wherein an area of the air inlet passage is formed to be smaller than an area of the air outlet passage.

* * * * *